US005687433A

United States Patent [19]

Garner et al.

[11] Patent Number: 5,687,433

[45] Date of Patent: Nov. 18, 1997

[54] CHILD BATH SEAT

[75] Inventors: Michael S. Garner, Northbrook; Craig S. Scherer, Wilmette; Michael C. Thuma, Desplaines, all of Ill.

[73] Assignee: BRK Brands, Inc., Aurora, Ill.

[21] Appl. No.: 670,556

[22] Filed: Jun. 27, 1996

[51] Int. Cl.[6] ..... A47K 3/12

[52] U.S. Cl. ..... 4/572.1; 4/579; 297/467; 297/256.15; 297/487

[58] Field of Search ..... 4/572.1, 571.1, 4/573.1, 578.1, 579, 586, 546; 297/5, 467, 464, 487, 488, 256.15

[56] References Cited

U.S. PATENT DOCUMENTS

| | | | |
|---|---|---|---|
| D. 131,137 | 1/1942 | Baumann, Sr. . | |
| D. 169,271 | 4/1953 | McWaide . | |
| D. 180,264 | 5/1957 | Black . | |
| D. 185,771 | 7/1959 | Mills . | |
| D. 188,838 | 9/1960 | Johnson . | |
| D. 195,255 | 5/1963 | Elliot et al. . | |
| D. 223,263 | 4/1972 | Goldstein . | |
| D. 261,828 | 11/1981 | Nakao et al. . | |
| D. 266,634 | 10/1982 | Knoedler et al. . | |
| D. 284,690 | 7/1986 | Mandelbaum . | |
| D. 288,118 | 2/1987 | Boucher . | |
| D. 304,135 | 10/1989 | Mergenov . | |
| D. 320,528 | 10/1991 | Bernstein et al. . | |
| D. 332,529 | 1/1993 | Shuler . | |
| D. 346,206 | 4/1994 | Crossley et al. . | |
| 913,310 | 2/1909 | Schreiber . | |
| 1,428,039 | 9/1922 | Kratz . | |
| 2,229,411 | 1/1941 | Hughes . | |
| 2,237,076 | 4/1941 | Kenney et al. . | |
| 2,246,108 | 6/1941 | Sermon . | |
| 2,285,900 | 6/1942 | Chapman . | |
| 2,468,742 | 5/1949 | Faulhaber . | |
| 2,503,938 | 4/1950 | Davis, Jr. . | |
| 2,562,628 | 7/1951 | McPeake, Jr. . | |
| 2,563,076 | 8/1951 | Schrechkengost . | |
| 2,645,781 | 7/1953 | Mover . | |
| 2,687,167 | 8/1954 | Janesick | 297/467 |
| 2,697,478 | 5/1954 | McKinney . | |
| 2,985,889 | 5/1961 | Fain et al. . | |
| 3,022,518 | 2/1962 | Hayden . | |
| 3,031,229 | 4/1962 | Symbaluk . | |
| 3,086,222 | 4/1963 | Hall et al. . | |
| 3,100,639 | 8/1963 | Bonewitz . | |
| 3,203,008 | 8/1965 | Murcott . | |
| 3,209,374 | 10/1965 | Walz . | |
| 3,245,717 | 4/1966 | Levy . | |
| 3,324,488 | 6/1967 | Schulz, Jr. . | |
| 3,422,466 | 1/1969 | Banoczi . | |
| 3,493,976 | 2/1970 | Bakeer . | |
| 3,504,927 | 4/1970 | Seki . | |
| 3,528,111 | 9/1970 | Chou . | |
| 3,619,823 | 11/1971 | Sackett . | |
| 3,718,365 | 2/1973 | Gibson . | |

(List continued on next page.)

FOREIGN PATENT DOCUMENTS

| | | | |
|---|---|---|---|
| 2572273 | 5/1986 | France | 4/572.1 |

*Primary Examiner*—Henry J. Recla
*Assistant Examiner*—Charles R. Eloshway
*Attorney, Agent, or Firm*—Dressler, Rockey, Milnamow & Katz,Ltd.

[57] ABSTRACT

A bath seat usable in a tub for infants and small children includes a seat portion with a curved back support mounted thereto. The base includes at least one deformable tub gripping element for removably affixing the seat to a bath tub. The seat includes first and second spaced apart, elongated members which are attached to regions of the back support and extend therefrom. A removable tray is adapted to slidably engage the elongated members. A releasable latch, carried in part on the tray and in part on at least one of the elongated members, locks the tray to the one elongated member in one of a plurality of linearly displaced positions. The seat includes a strut extending between the base and the tray to lockingly engage and support the tray. The strut prevents a child from slipping under the tray and maintains the child in the seat during the bath.

5 Claims, 4 Drawing Sheets

U.S. PATENT DOCUMENTS

| | | | |
|---|---|---|---|
| 3,796,430 | 3/1974 | Sudo . | |
| 3,995,331 | 12/1976 | Fotre et al. . | |
| 4,150,445 | 4/1979 | Bailey . | |
| 4,226,467 | 10/1980 | Boudreau . | |
| 4,266,306 | 5/1981 | Lee . | |
| 4,650,246 | 3/1987 | Henrickson . | |
| 4,687,452 | 8/1987 | Hull . | |
| 4,822,030 | 4/1989 | Cone . | |
| 5,010,606 | 4/1991 | Bernstein et al. | 297/467 |
| 5,094,505 | 3/1992 | Nicholas . | |
| 5,158,460 | 10/1992 | Bernstein et al. . | |
| 5,317,765 | 6/1994 | Knoedler et al. | 4/572.1 |
| 5,321,859 | 6/1994 | Buckshaw et al. | 4/572.1 |
| 5,425,149 | 6/1995 | Crossley et al. . | |
| 5,427,432 | 6/1995 | Meeker et al. | 297/256.15 |
| 5,507,550 | 4/1996 | Maloney | 297/467 |

CHILD BATH SEAT

FIELD OF THE INVENTION

This invention relates to child bath seats. More particularly, the invention relates to child bath seats having a relatively rigid, curved seat portion and an adjustable front tray support.

BACKGROUND OF THE INVENTION

Children's bath seats are commonly used to support a small child or an infant during a bath. Infants and small children may not yet be capable of supporting or holding themselves in a seated position during a bath, thus, some support of some type may be desirable. Moreover, bath tubs can become slippery when wet. As such, it is desirable to have a support to hold small children or infants in a supported position to facilitate the bath, and to prevent the child from falling against the tub surface.

Without a support, such as a bath seat, the individual bathing the child must support the child with one hand while washing the child with the other hand. This can become difficult, and may also lead to back strain for the individual bathing the child.

One known bath support includes a ring which is supported by a plurality of legs. The legs include suction cups to affix the ring to the bath tub, and to prevent movement of the ring during the bath. The legs also raise the ring above the tub surface to permit readily placing the child's legs between the ring and the tub.

The ring serves as a support for the child to lean on during the bath. While such rings adequately support the child during the bath, it is possible that the child may still slip under the ring when the tub is wet. Often, a sponge or other non-slip pad is placed under the child to keep the child in place.

Another known bath support includes a chair hingedly mounted to a base portion. The chair angle, relative to the base portion, is adjustable. The base portion includes a rail which extends upwardly and forwardly from the base at the rear of the chair. The rail also serves as a front support for the child.

The chair angle is adjusted by engaging tabs which extend from the sides thereof, with one of a plurality of slots in the rail. While this type of bath seat provides support for the child, the distance between the chair back, in a relatively upright position, and the front support is fixed. Therefore, the desired front support for the child may not be achievable.

Accordingly, there continues to be a need for a bath seat which provides adjustable front support and rear support for a child or infant, in a curved seat. Preferably, the seat provides a tray area for toys for the child or for placing cleaning items for the individual bathing the child.

SUMMARY OF THE INVENTION

A child bath seat usable in a tub for infants and small children includes a base portion with a seat and a curved back support, and a removable support tray. The base portion includes at least one deformable tub gripping element, such as a suction cup, carried thereon, for removably affixing the seat to the tub The seat includes first and second spaced apart, elongated latching members extending generally from the back support and extend therefrom.

The removable tray slidably engages the latching members. The tray includes at least one releasable latch carried in part on the tray and in part on at least one of the latching members. The latch locks the tray to the latching member in one of a plurality of linearly displaced positions.

In one embodiment, the seat includes a pair of latches, each including a releasing member to facilitate releasing the tray from the seat. The latch is configured to permit the tray to be readily slid into engagement with the seat, and is further configured to prevent inadvertent disengagement thereof.

In a preferred embodiment, the bath seat includes two latching members extending generally parallel to one another. Preferably, the bath seat includes a plurality of tub gripping elements carried on the base.

In another embodiment, the bath seat includes a strut extending between the base and the tray. The strut lockingly engages the tray to the base portion, and further prevents a child from sliding out of the seat, under the tray, while in the bath.

Other features and advantages of the present invention will be apparent from the following detailed description, the accompanying drawings, and the appended claims.

DETAILED DESCRIPTION OF THE PREFERRED EMBODIMENTS

Figure 1:
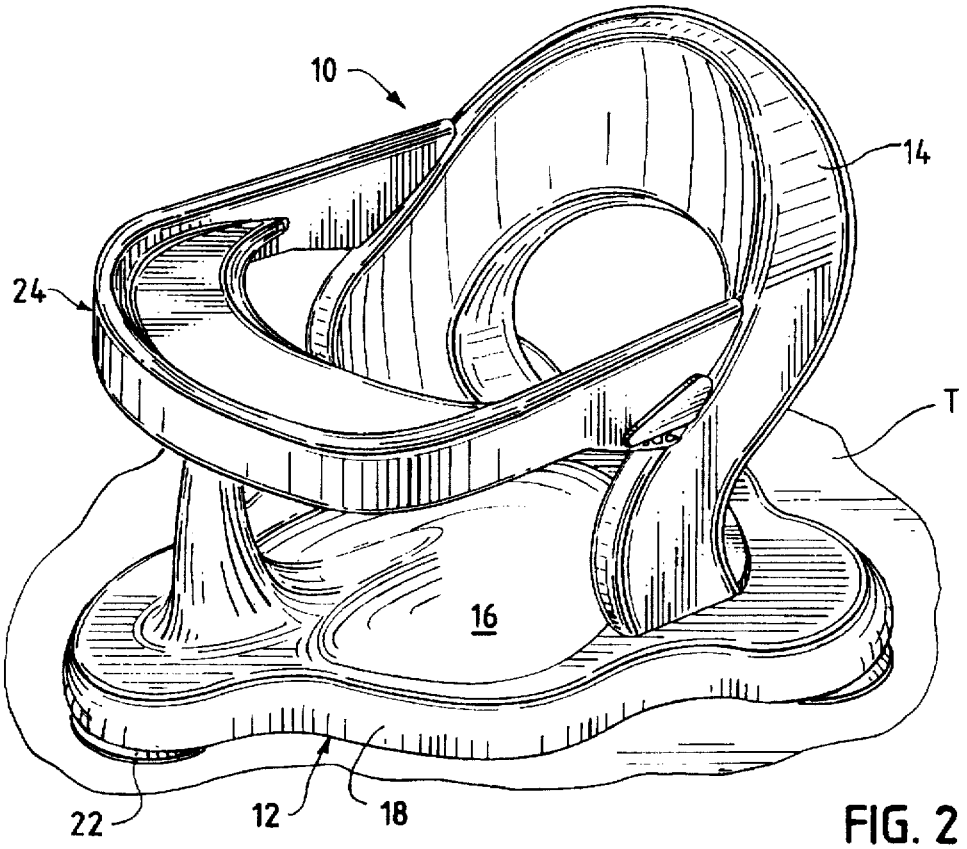
FIG. 1 is a front perspective view of a child bath seat embodying the principles of the present invention.
Figure 2:
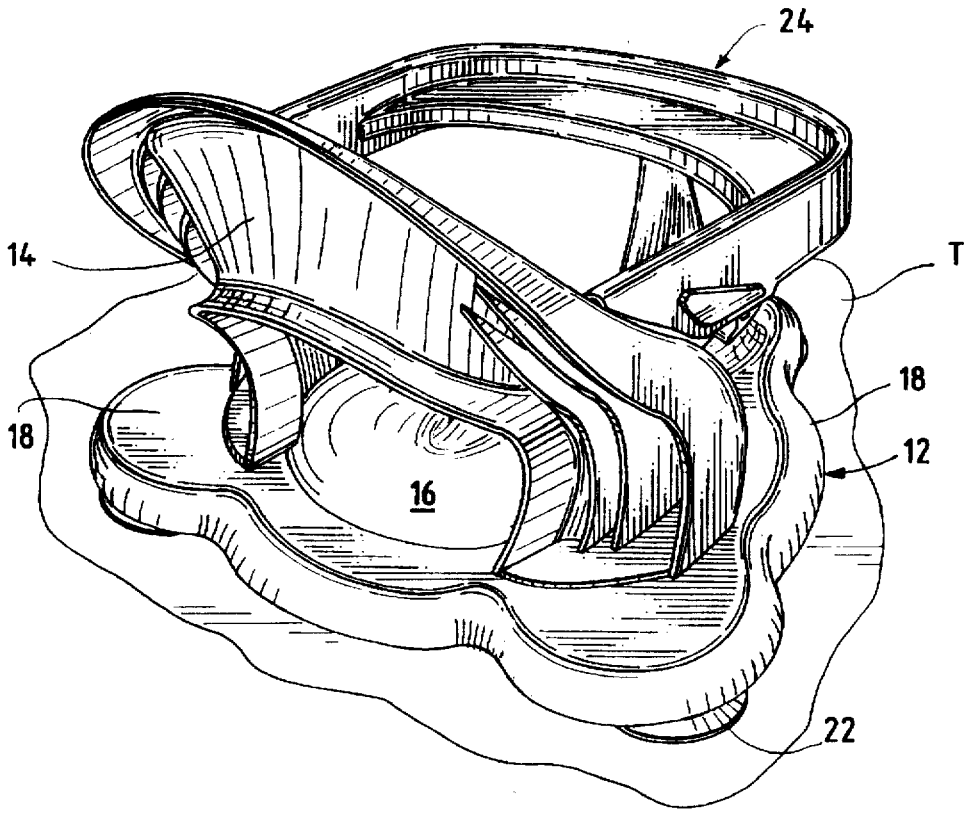
FIG. 2 is a rear perspective view of the child bath seat of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

With reference now to the figures, and particularly to FIG. 1, a bath seat 10 embodying the principles of the present invention is illustrated. The bath seat 10 includes a seat portion 12 having a curved back support 14 and a seat bottom 16. The back support 14 is erogonometrically contoured to fit an "average" child, to provide a comfortable seating environment for the child.

The seat 10 is configured such that when seated, a child's bottom is raised from the tub surface T. This permits the child to be in a generally seated position, and keeps the child in the bath seat with his or her bottom on the seat bottom 16, rather than on the tub bottom surface T.

The bath seat 10 also includes a base portion 18 to which the back support 14 is mounted. The base portion 18 provides a seating surface for the child, and provides support for the overall bath seat 10 structure.

The back support 14 is mounted to the base portion 18 by a plurality of locking elements 20 (see FIG. 3) which insert into and lock into the base portion 18. The configuration maintains the back support 14 mounted to the base portion 18. The seat portion 12 may also include drainage openings (not shown) therein, to facilitate draining water and soap residue from the bath seat 10.

The base portion 18 is adapted to be affixed to the bath tub surface T to minimize or prevent movement of the seat 10 during the child's bath. In one embodiment, the base portion 18 includes at least one, and preferably a plurality of deformable gripping elements, such as the exemplary suction cups 22. The bath seat 10 illustrated in FIG. 3 includes three such suction cups 22 located about equidistant from one another, about the base portion 18.

The seat 10 includes a removable support tray 24. The tray 24 is positioned forward of the back support 14, and is held in place, and mounted to the back support 14 by at least one latch mechanism 26. The illustrated seat includes two such latch mechanisms 26*a,b*.

Figure 3:
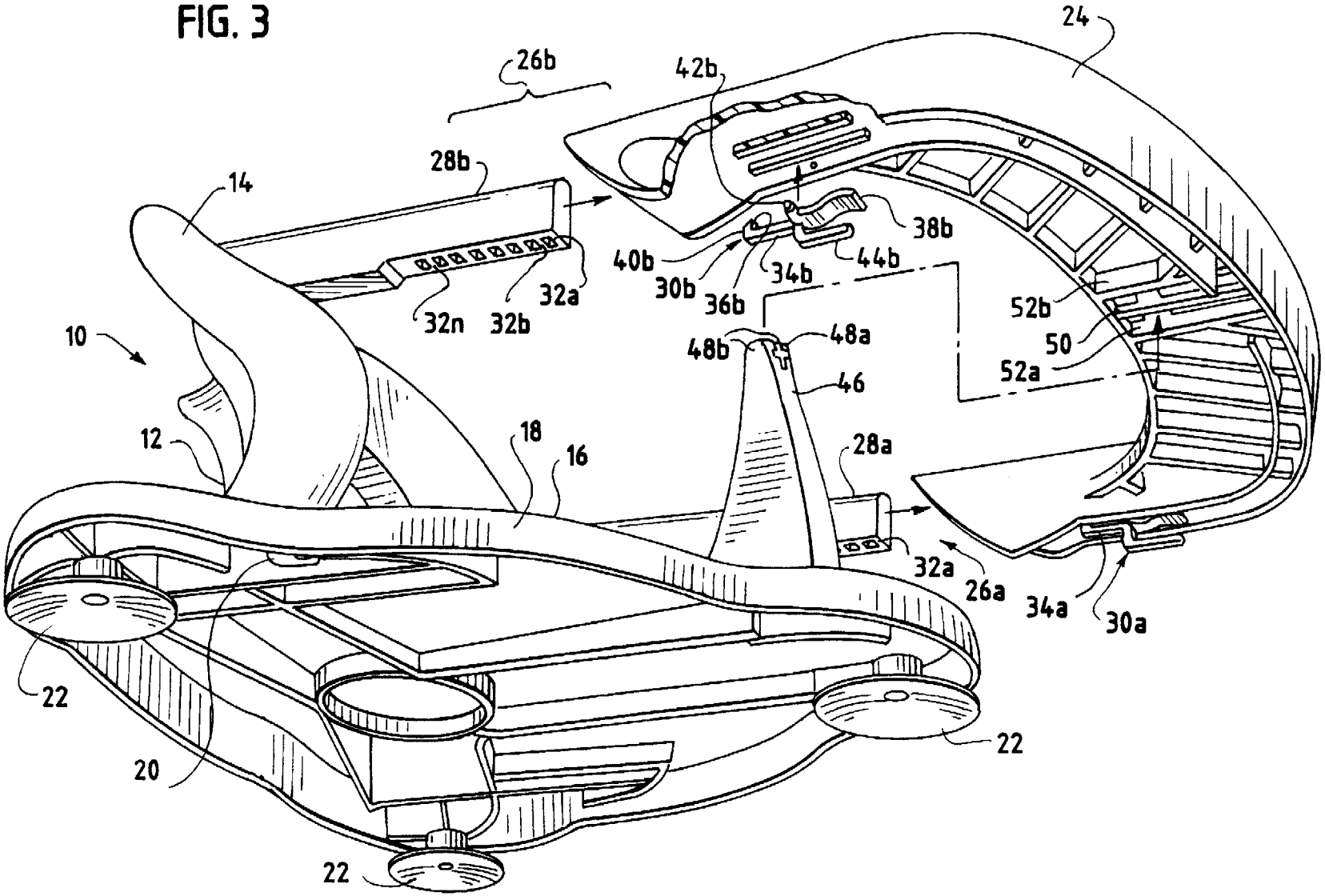
FIG. 3 is an exploded, front-bottom perspective view of the child bath seat of FIG. 1, illustrated with the support tray removed.
Figure 4:
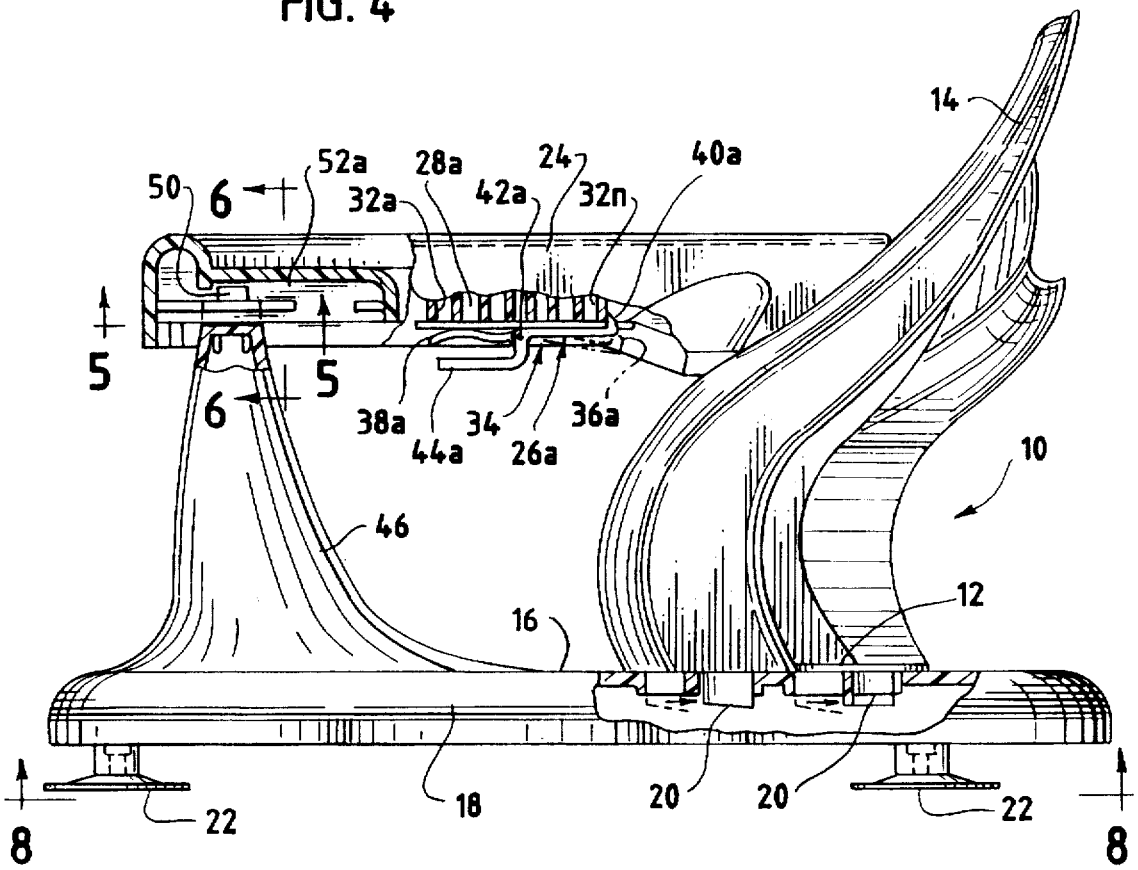
FIG. 4 is a side view, shown in partial cross-section, of the child bath seat of FIG. 1, illustrating the tray lock and back support lock elements.
Figure 5:
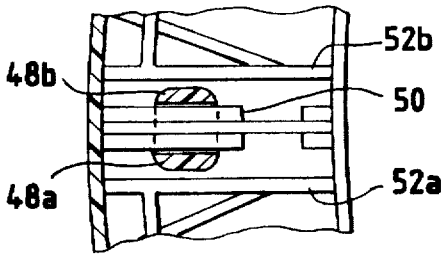
FIG. 5 is a cross-sectional view, taken along line 5—5 of FIG. 4, illustrating the tray to tray strut connection.
Figure 6:
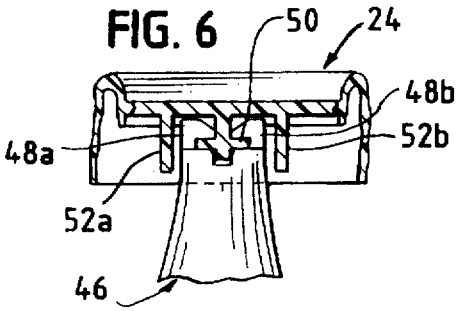
FIG. 6 is a cross sectional view taken along line 6—6 of FIG. 4, also illustrating the tray to tray strut connection.
Figure 7:
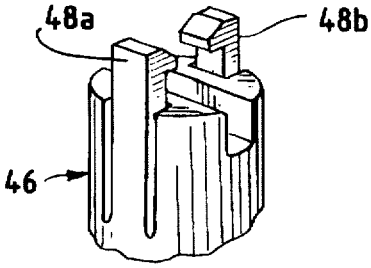
FIG. 7 is a partial perspective view of the tray end of the tray strut, illustrating the tray engaging elements.
Figure 8:
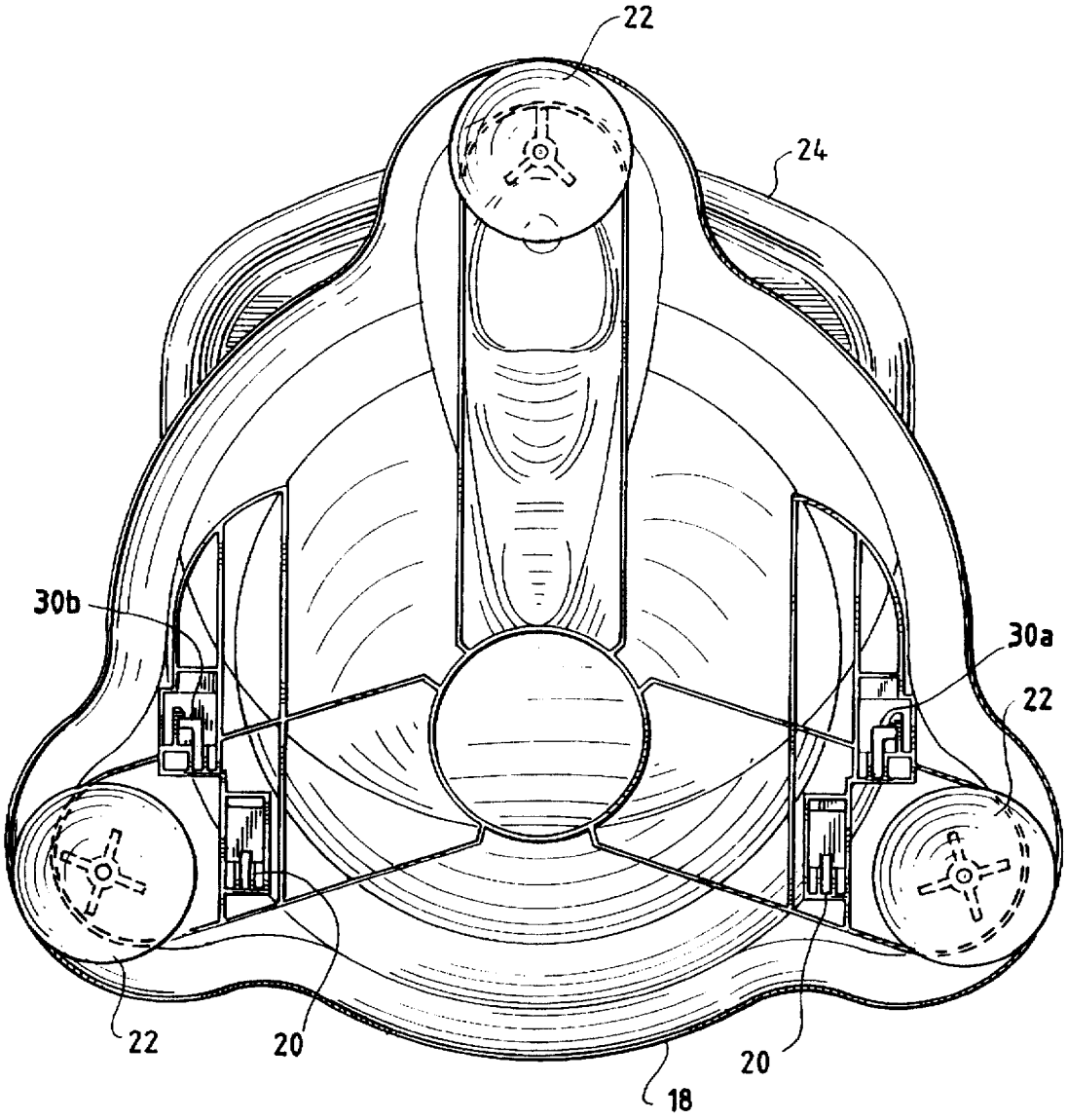
FIG. 8 is a bottom view of the child bath seat of FIG. 1, as viewed along line 8—8 of FIG. 4.

Referring to FIG. 3 and FIG. 4 (in which one latch mechanism 26*a* is shown) a pair of elongated latching members 28*a,b* extend from the back support 14, generally horizontally, and transverse relative to the back support 14. The support tray 24 includes a pair of latches 30*a,b* each adapted to receive a respective latching member 28*a,b*, and each on a respective side of the tray 24.

The latching members 28*a,b* each include a plurality of spaced apart stops or detents 32*a*–32*n*, formed therein. The detents 32*a*–32*n* are configured to coact with and to engage the latches 30*a,b* on the support tray 24.

The latches 30*a,b* each include a biased, pivotable main body portion 34*a,b* having a hook-like engagement member 36*a,b* on one end thereof and a slide member 38*a,b* on the other end thereof. Each hook-like member 36*a,b* includes an inclined surface 40*a,b* to facilitate engaging the Way 24 with the latching members 28*a,b*. The slide members 38*a,b* are adapted to slide along their respective latching members 28*a,b* as the tray 24 is engaged therewith.

The latches 30*a,b* each include a pivot element 42*a,b* intermediate the slide members 38*a,b* and hook-like members 36*a,b*. The latches 30*a,b* each include a releasing member 44*a,b*, each extending from about the pivot 42*a,b*, generally parallel to and in spaced relation from, the slide members 38*a,b*. The hook-like members 36*a,b* prevent inadvertent removal of the support tray 24 from the seat 10, while the inclined surfaces 40*a,b* provide easy engagement therebetween.

As the releasing members 44*a,b* are depressed, or urged toward their respective slide members 38*a,b*, the hook-like members 36*a,b* are moved away, and disengaged from, the detents 32*a*–32*n* in the latching members 28*a,b*.

The tray 24 can then be removed from the seat 10. Preferably, the hook-like members 36*a,b* are biased toward the detents 32*a*–32*n* and the latching members 28*a,b*, which maintains the tray 24 in engagement with the seat 10.

The seat 10 may also include a support tray strut 46. The strut 46 extends upwardly from the base 18 and engages the tray 24 to provide rigidity to the tray 24. The strut 46 includes a pair of engaging elements 48*a,b* which engage an elongated T-shaped runner 50 which extends from the tray 24 bottom. Engagement of the engaging elements 48*a,b* with the T-shaped runner 50 maintains the tray 24 in supporting engagement with the strut 46. The tray 24 includes a pair of aligning walls 52*a,b* which extend from the tray 24 bottom, parallel to, and on either side of, the T-shaped runner 50. The aligning walls 52*a,b* facilitate proper engagement of the tray 24 and the strut 46.

As configured, when the seat 10 is in use, the strut 46 is positioned between the child's legs. This prevents the child from slipping under the tray 24 and facilitates maintaining the child in the seat 10 during the bath.

In use, the seat 10 is affixed to the bottom surface of the tub T. The tray 24 can be fully removed from the seat 10, or it can be positioned a sufficient distance from the back support 14 to readily permit placing the child in the seat 10.

Once the child is in place in the seat 10, the tray 24 is slid into place and is moved inwardly, toward the child until the desired position is achieved. As noted previously, the plurality of detents 32*a*–32*n* or stops provides a wide range of settings for positioning the tray 24 relative to the seat back support 14. That is, the present configuration provides a plurality of linearly displaced positions for the tray 24 relative to the back support 14.

The inclined surfaces 40*a,b* on the latches 30*a,b* provide easy inward movement of the tray 24 relative to the back support 14 and the child. The hook-like members 36*a,b* engage the detents 32*a*–32*n*, and prevent inadvertent removal of the tray 24 from the seat portion 12.

When the child's bath is finished, the tray 24 is readily removed from the seat 10. The releasing members 44*a,b* are urged upward, which in turn disengages the hook-like members 36*a,b* from the detents 32*a*–32*n*. The tray 24 can then be easily slid from the elongated latching members 28*a,b* and the tray 24 can be removed from the seat 10.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A molded child bath seat comprising:

a molded, partly open back;

a base to which the back is coupled, said base adapted to extend in a first plane in use;

first and second spaced apart tray support elongated side elements;

an elongated child retaining member which extends from the base, centrally located at an end of the base, displaced from the back and equidistant from the tray supporting elements wherein the retaining member has a free end displaced from the base, wherein the free end carries first and second spaced apart, opposed, surfaces for balancing and slidably retaining a tray;

first and second manually operable latch elements carried, at least in part, on the tray supporting elements;

a tray linearly movable in a second plane which is parallel to said first plane wherein the tray carries first and second slots for receiving the first and second tray supporting elements and a balancing element which extends therefrom, between the slots, wherein the balancing element is linearly slidable in said second plane to engage spaced apart surfaces and engages another portion of the free end and is not liftable from those surfaces when so engaged and wherein the latch elements define a plurality of spaced apart locking positions for the tray.

2. A bath seat as in claim 1 wherein the tray carries third and fourth latch elements, wherein the first and third and second and fourth elements releasably engage one another at a plurality of spaced apart locations.

3. A bath seat as in claim 2 wherein each of the third and fourth latch elements includes a manually releasable handle wherein when released, the tray is slidable on the tray supporting elements and wherein the slidable engagement of the balancing element and the opposed surfaces blocks movement away from the tray supports.

4. A molded child bath seat comprising:

a molded, partly open back;

a base to which the back is coupled, said base adapted to extend in a first plane in use;

first and second spaced apart elongated tray support side elements;

an elongated anti-slide child retaining member which extends from the base, centrally located at an end of the base, displaced from the back and equidistant from the tray supporting elements wherein the retaining member has a free end displaced from the base, wherein the free end carries at least a first hook-like element for slidably retaining a tray;

at least one manually operable lock element carried, at least in part, on one of the tray support elements;

a tray linearly movable in a second plane which is parallel to said first plane wherein the tray carries first and second slots for receiving the first and second tray supporting elements and a central element which extends therefrom, between the slots, wherein the central element is linearly slidable in said second plane to engage at least the hook-like element and wherein the tray is not liftable when so engaged.

5. A bath seat as in claim 4 which includes a second hook-like element, spaced from the first element, wherein the central element is adapted to slide between and is retained adjacent to the hook-like elements.

* * * * *